United States Patent [19]

Dickey

[11] 4,116,442

[45] Sep. 26, 1978

[54] SIMULATED BASEBALL GAME

[76] Inventor: George W. Dickey, 1421 N. University, N-125, Little Rock, Ark. 72207

[21] Appl. No.: 824,173

[22] Filed: Aug. 12, 1977

[51] Int. Cl.[2] ..... A63F 7/06

[52] U.S. Cl. ..... 273/89; 273/129 HB; 273/129 E

[58] Field of Search ..... 273/89, 90, 129 HB, 273/85 A, 85 B, 129 HA, 120 R, 129 E

[56] References Cited

U.S. PATENT DOCUMENTS

| | | | |
|---|---|---|---|
| 487,825 | 12/1892 | Curtis, Jr. et al. | 273/89 |
| 1,033,249 | 7/1912 | Johnson | 273/89 |
| 1,346,782 | 7/1920 | Gehring | 273/89 |
| 1,718,455 | 6/1929 | Craig | 273/89 |
| 1,994,685 | 3/1935 | Callejas | 273/89 |
| 2,645,489 | 7/1953 | Burgess | 273/90 |
| 2,757,003 | 7/1956 | Lawther | 273/89 |
| 3,355,173 | 11/1967 | Selker | 273/89 |
| 3,358,997 | 12/1967 | Belz | 273/89 |
| 3,391,937 | 7/1968 | Seiden | 273/129 HA |
| 3,854,720 | 12/1974 | Duvall | 273/89 |

FOREIGN PATENT DOCUMENTS

| | | | |
|---|---|---|---|
| 680,723 | 2/1964 | Canada | 273/85 B |

*Primary Examiner*—Richard C. Pinkham
*Assistant Examiner*—Harry G. Strappello
*Attorney, Agent, or Firm*—Watson, Cole, Grindle & Watson

[57] ABSTRACT

A baseball game includes a board having a playing surface with upstanding walls attached to marginal edges thereof forming a fence, markings on the surface to simulate a baseball field, and simulated players on the surface at infield and outfield positions of the field. A bat in the form of an L-shaped member is located at the home plate position with one leg thereof having a lower surface resting on the playing surface and another leg thereof extending downwardly through an opening provided in the board. A launcher for a ball to be played extends toward the bat and rests at one end on the playing surface and between opposite ends on an upper edge of one of the fence walls. The ball may therefore be batted as the downwardly extending leg of the bat is rotated about its central axis so as to swing the one leg through a batting movement.

5 Claims, 5 Drawing Figures

SIMULATED BASEBALL GAME

BACKGROUND OF THE INVENTION

This invention relates generally to a game for simulating the play of baseball and, more particularly to such game having a ball launcher, a swing bat and ball interceptors at various infield and outfield positions.

SUMMARY OF THE INVENTION

An object of the present invention is to provide a simulated baseball game having a ball launcher and a swing bat of simple construction yet highly effective in carrying out a parlor baseball game in such a manner that a wide variety of baseball plays is made possible.

In carrying out this general objective, an elongated ball launcher extends toward the batter, rests at one end on the playing surface of the game board and rests between its ends on an upper edge of a fence wall mounted on the game board so as to thereby present a downwardly sloping guide. The bat is in the form of an L-shaped member having one leg resting on the playing surface and the other leg thereof extending through one of a pair of openings provided in the game board so as to facilitate swinging movement of the one leg for a left-handed or a right-handed batter depending on which of the openings the other leg extends. Such other leg is rotated in one or the other directions about its central axis to effect swinging movement of the one leg. And, the one leg has a flat lower surface and opposing side surfaces which are reversely curved so as to define a bell-shaped cross-section for the one leg. The ball may, therefore, be batted as either side surface of the one leg, depending on the swing of the bat, impacts with the ball so as to cause it to travel along the game board or in one of different trajectories. The launcher may be in the form of a hollow tube having a handle portion extending outwardly of the game board so that, when slightly rotated, the one end of the launcher resting on the game board will be correspondingly rotated to deflect the launch of the ball as it moves toward the batter. And, interceptors in the form of upstanding plates having concave surfaces facing the batter are provided at various infield and outfield positions on the game board.

DETAILED DESCRIPTION OF THE INVENTION

Figure 1:
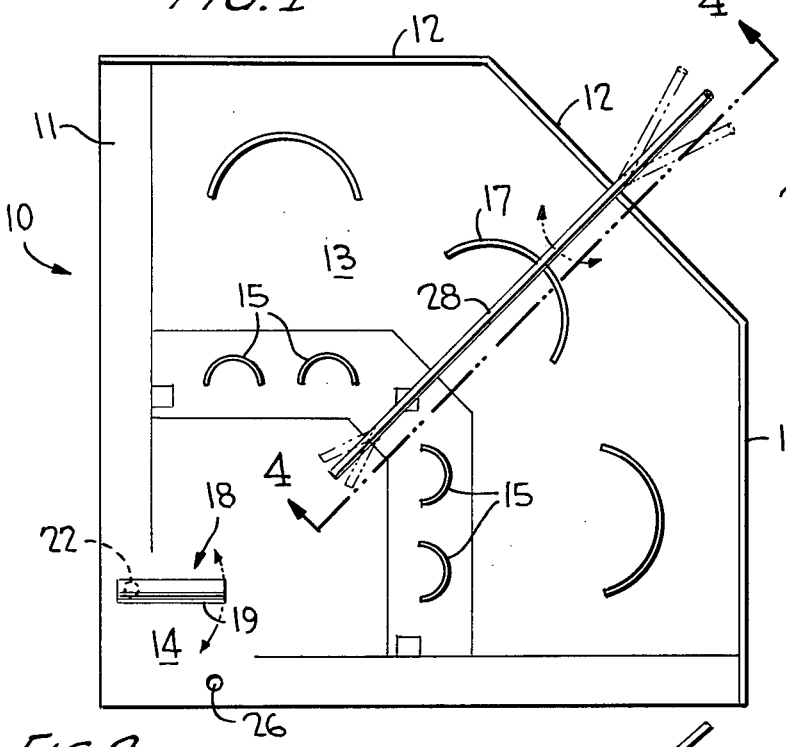
FIG. 1 is a top plan view of the simulated baseball game in accordance with the present invention.

Turning now to the drawings wherein like reference characters refer to like and corresponding parts throughout the several views, the simulated baseball game according to the present invention is generally designated 10 in the drawings and comprises a game board 11 having upstanding walls 12 secured in any normal manner to several of the marginal edges thereof so as to define an outfield fence. An upper surface 13 of the board defines a playing surface with markings thereon laid out in the manner of a conventional baseball field having bases, foul lines, etc. The playing surface may be comprised of a relatively smooth covering to permit the ball, when pitched, to travel along a straight path toward the home plate position generally indicated at 14. Or, playing surface 13 may be comprised of a relatively rough covering which would tend to cause the ball, when pitched, to curve or deflect and therefore render the path of the pitched ball more unpredictable thereby distorting the timing of the batter.

Interceptors in the form of short upstanding curved plates 15 are positioned on the game board and may be mounted in any normal manner placed, if desired, at the infield so as to simulate the short stop and the first, second and third basemen positions. Other interceptors in the form of slightly taller plates 17 are positioned on the game board in the outfield so as to simulate the left-, center- and right-field player positions. Both sets of plates 15 and 17 are oriented as shown in FIG. 1 so that their respective concave surfaces generally face the home plate position.

Figure 3:
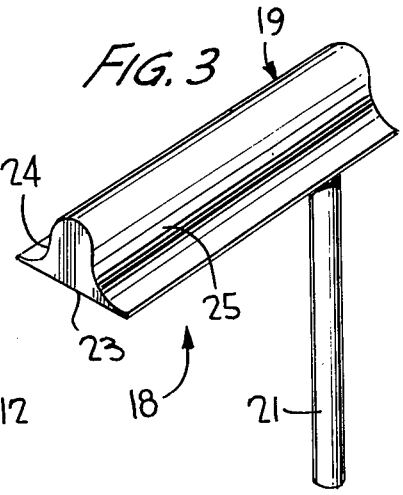
FIG. 3 is a perspective view at a slightly larger scale, of the bat used with the game according to the invention.

A substantially L-shaped batting element 18 is located at the home plate position and includes a leg member 19 thereof resting on upper surface 13, with the other leg member 21 thereof fixedly secured to member 19 and extending downwardly through an opening 22 provided in the game board. Leg member 21 is of circular cross-section, while leg member 19 is substantially bell-shaped in cross-section as clearly illustrated in FIG. 3 of the drawings. Member 19 therefore has a flat lower surface 23 which rests directly on the playing surface, and opposite side surfaces 24 and 25 of this leg member are reversely curved as illustrated for a purpose to be more clearly brought out hereinafter.

Figure 2:
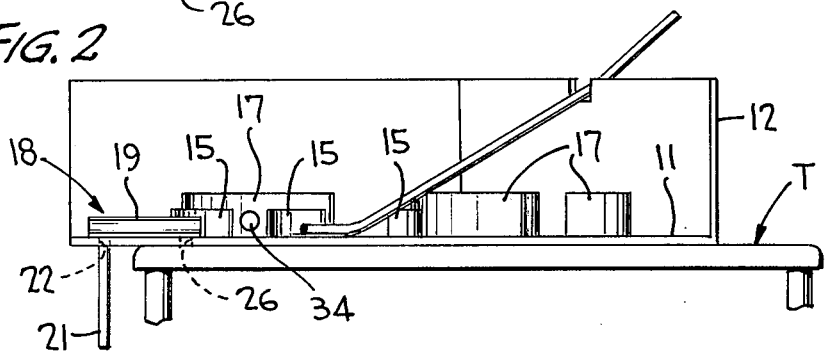
FIG. 2 is an end elevational view of the game as shown in FIG. 1 as resting on a table top, a showing of the launcher being omitted for clarity.

For batting a pitched ball, leg member 21 is gripped by the thumb and fingers of the operator on the offensive team and is rotated about the central longitudinal axis thereof so as to thereby cause leg member 19 to be likewise rotated or shifted about such axis in a direction depending on the direction of rotation of member 21. Typically, for a right-handed batter, leg member 21 extends through opening 22 which is disposed, as shown in FIGS. 1 and 2, typically on the side of the home plate at which a right-handed batter would normally stand. Thus, member 21 is rotated in a counterclockwise direction when viewing FIG. 1 so as to present side surface 25 of member 19 to the batted ball. And, for a left-handed batter normally positioned at the opposite side of the home plate, another opening 26 is provided in the game board through which leg member 21 extends so that, upon rotation of member 21 in a clockwise direction, side surface 24 of member 19 is presented to the pitched ball for batting.

Figure 5:
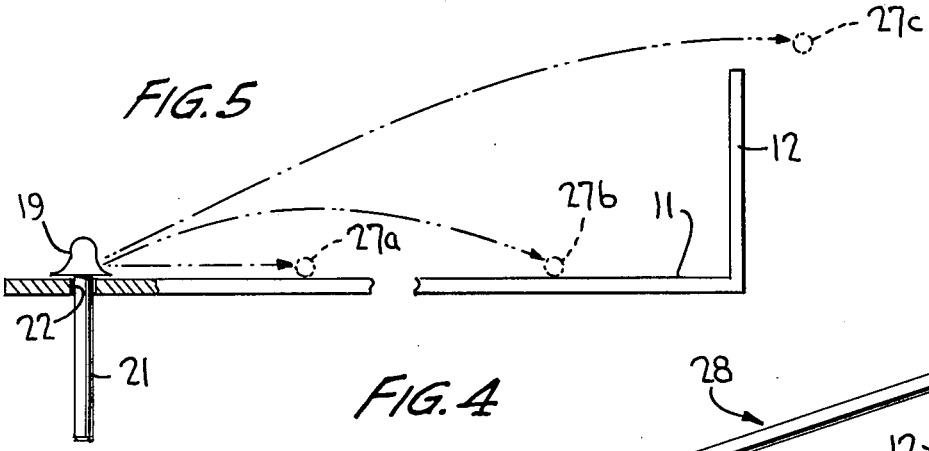
FIG. 5 is an end elevational view of the FIG. 1 game board showing different possible movements of the ball when batted, the launcher and interceptors being omitted for the sake of clarity.
Figure 4:
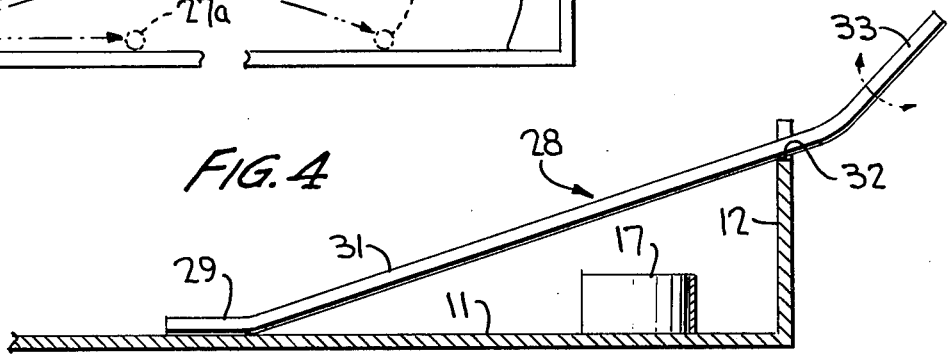
FIG. 4 is a sectional view of the game board taken substantially along 4–4 of FIG. 1 and showing the launcher in side elevation.

The ball used in the play of the present baseball game is shown in dotted outline in FIG. 5 as at 27, the ball comparing in weight and size to that of a typical playing marble. A launcher, generally in the form of an elongated hollow tube 28, is provided for guiding the ball toward the batter to effect the play of the game. Tube 28 rests flatly at one end portion 29 thereof directly on the playing surface at an area just inside the second base marking. A central portion 31 of the tube is angularly related to end portion 29 and rests on an upper edge of wall 12 which lies behind the second base position as shown in FIG. 1. Portion 31 may rest directly on an edge of this wall or an edge of an open notch 32 (FIG. 4) for purposes of stabilizing the tube during ball launching. Central portion 31 of the tube extends slightly outwardly of wall 12 and is bent upwardly at its outer end portion 33. Hence, ball 27 may be inserted through end 33 of the tube so as to be guided along the tube and outwardly of end 29 whereupon it will roll along the playing surface toward the batting element. The opposing player then rotates leg member 21 so as to shift member 19 in a clockwise or counter-clockwise direction (depending which of the openings leg member 21 extends) about the axis of member 21 in an attempt to bat the ball. And, depending on the force of the swing, the size and weight of the bat, the timing of the swung bat and the point of impact between the ball and a side surface of leg member 19, the ball will be made to follow one of several trajectories, as shown in FIG. 1. For example, ball 27*a* when batted may follow a substantially straight path along the playing surface, or ball 27*b* may follow a curved path as it moves over one of interceptors 15, or ball 27*c* may follow another curved path taking it over one of the walls 12.

It should be pointed out that the playing ball may likewise be provided with a relatively smooth or a rough covering depending on whether the ball's path is to be deflected or not after it leaves the launcher and proceeds toward the batting element.

The tube may be slightly rotated about the axis of its central portion 31 by shifting portion 33 slightly in one direction or another, as shown in phantom outline in FIG. 1, so as to correspondingly shift end portion 29 (also shown in phantom outline) to slightly divert the pitched ball when proceeding toward the batter. Also, end portion 33 of the tube may be moved upwardly a desired distance above wall 12 on which the tube rests, in the direction of the double arrows shown in FIG. 4, so as to affect the pull of gravity on the ball as it proceeds down the tube. A change in speed of the pitched ball is therefore made possible.

Various batting elements 18 may be utilized for changing the batting efficiency. Thus, batting elements having leg members 19 with different sizes, weights and densities may be selected by an offensive player.

Also, interceptors 15 and 17 having different widths and heights may be selected by the defensive player and positioned in place at different areas, within their respective infield and outfield locations, before the ball is batted so as to alter the fielding efficiency of the defensive team.

The game according to the invention is played between at least two players following the standard rules of American baseball.

The game may also be played from a managerial, coaching or ownership level wherein bats of three different types, for example, would be utilized and graded A, B and C relating to different levels of hitting efficiency as mentioned above. Level A would denote the best and level C would denote the poorest hitting efficiency. There would also be two different levels of fielding efficiency as denoted previously by the varying dimensions of the infielders and/or outfielders. Level A would denote the larger fielders capable of covering larger fielding areas and thus intercepting more hit balls as compared to the lesser fielders denoted B.

Also introduced for the play of the game could be the element of speed, or base-stealing ability graded A, B and C. The A level would denote the best ability and the C level the poorest. Base-stealing would be determined by statistical odds based upon a throw of dice which also makes possible the introduction of a psycological aspect in that, if the base stealer does not steal although the defensive team believes the runner intends to steal a base, the statistical odds for the base-stealer would become more advantageous. The reverse situation results in different statistical odds. Four possible combinations would include: pitcher does not think runner will steal — base runner does steal; pitcher does not think runner will steal — base runner does not steal; pitcher thinks base runner will steal — base runner does steal; and pitcher thinks runner will steal — base runner does not steal. The statistical odds involving a roll of dice, would be delineated by the base stealing chart.

Also, the game may be played on two levels such as purely a skill level or a level involving the buying of players so as to achieve the best team possible, then each team would start out with a predetermined amount of paper money with which to buy the best team possible: A, B, C hitters; A, B fielders; and A, B, C, base-stealers. The value of the various baseball players might be based on the following point count: Base-stealer A — 1 point; Hitter A — 2½ points; Fielder A — 2½ points; Base-stealer B — ¾ point; Hitter B — 1½ points; Fielder B — 1½ points; Base-stealer C — ¾ point; and Hitter C — ¾ point.

Prices could then be placed upon players based upon different combinations such as Hitter A, Fielder A and Base-stealer A, costing the most. Thus, an upper or managerial level of the baseball game is made possible with the present invention.

The game board may typically be placed upon the top of a table T shown in FIG. 2 so that leg 21 of the batting element extends outwardly of one side of the table as shown. Manipulation of the batting element effects batting of the ball which may be knocked foul or out-of-the-ball park or onto some in-play portion of the playing field. One's best offense is the best batter or base-stealer — one's best defense is the best (biggest) fielder. The pitcher may throw different types of pitches or balls at the batter to destroy his timing.

In accordance with another aspect of the game according to the invention, each of the interceptors 15 and 17 may be provided at a central portion thereof with a pressure plug fitting 34 (FIG. 2) which, when hit by the ball, would dislodge to thereby determine an error committed by that player. And, the type of error committed would be determined by the particular location of the fielder at the time.

Obviously, many modifications and variations of the invention are made possible in light of the above teachings. It is therefore to be understood that within the scope of the appended claims the invention may be practiced otherwise than as specifically described.

I claim:

1. In a simulated baseball game including a board having an upper playing surface with upstanding walls attached to marginal edges thereof forming a fence, markings provided on said surface in the manner of a baseball field, and simulated players at infield and outfield positions in the form of upstanding interceptors mounted on said surface, the improvement comprising:

a bat disposed at a home plate position of said surface as marked, said bat comprising a substantially L-shaped member, one leg of said member having a lower surface resting on said playing surface and having opposing side surfaces, the other leg of said member extending downwardly through a first opening provided in said board for rotatable movement about the central axis thereof, and a launcher for directing a ball to be used in playing the game toward said one leg, said launcher comprising an elongated guide element in the form of a hollow tube extending toward said bat, said guide element having one end portion initially lying flatly against said playing surface, a central portion of said tube being disposed at an angle to said one end portion and resting on an upper edge of one of said walls, and an end portion of said guide element opposite said one end portion extending upwardly at an angle to said central portion and forming a handle for said tube, whereby the ball may be directed by said launcher for rolling along said playing surface in different directions toward said bat as said central portion is rotated about its axis upon movement of said handle so that the ball may be batted by one of said side surfaces of said one leg as said other leg is rotated in one direction about said axis and toward said launcher.

2. The game according to claim 1, wherein a second opening spaced from said first opening is provided in said board through which said other leg may alternatively extend, whereby the ball may be batted by the other of said side surfaces of said one leg as said other leg is rotated in a direction opposite said one direction about said axis and toward said launcher.

3. The game according to claim 2, wherein said one leg is substantially bell-shaped in cross-section defining opposed outwardly facing concave surfaces so that, depending on the point of impact with the ball at said other side surface, the ball may be batted along said playing surface or along one of different trajectories.

4. The game according to claim 1, wherein said one leg is substantially bell-shaped in cross-section so that, depending on the point of impact with the ball at said one side surface, the ball may be batted along said playing surface or along one of different trajectories.

5. The game according to claim 1, wherein each of said interceptors comprises a plate member having a concave surface facing said bat.

* * * * *